US009406210B2

(12) United States Patent
Kim et al.

(10) Patent No.: US 9,406,210 B2
(45) Date of Patent: Aug. 2, 2016

(54) APPARATUS AND METHOD FOR SUPPORTING SAFE LIVING

(71) Applicant: Electronics and Tellecommunications Research Institute, Daejeon (KR)

(72) Inventors: Ji-Yeon Kim, Daejeon (KR); Eun-Jin Ko, Daejeon (KR); Jong-Hyun Jang, Daejeon (KR); Deock-Gu Jee, Daejeon (KR)

(73) Assignee: Electronics and Telecommunications Research Instit, Daejeon (KR)

( * ) Notice: Subject to any disclaimer, the term of this patent is extended or adjusted under 35 U.S.C. 154(b) by 0 days.

(21) Appl. No.: 14/627,101

(22) Filed: Feb. 20, 2015

(65) Prior Publication Data

US 2015/0262466 A1 Sep. 17, 2015

(30) Foreign Application Priority Data

Mar. 12, 2014 (KR) ..... 10-2014-0029084

(51) Int. Cl.
*G08B 23/00* (2006.01)
*G08B 21/04* (2006.01)

(52) U.S. Cl.
CPC ..... *G08B 21/0423* (2013.01); *G08B 21/0484* (2013.01); *G08B 21/0492* (2013.01)

(58) Field of Classification Search
CPC ..... G08B 21/0407; A61B 5/7465; A61B 2505/07; G06Q 50/22
USPC ..... 340/517, 539.3, 539.23, 573.1; 705/2
See application file for complete search history.

(56) References Cited

U.S. PATENT DOCUMENTS

| | | | | |
|---|---|---|---|---|
| 7,733,224 | B2 * | 6/2010 | Tran | G06F 19/3418 340/3.1 |
| 7,847,682 | B2 * | 12/2010 | Jung | G06Q 10/00 340/522 |
| 8,184,001 | B2 | 5/2012 | Kuris et al. | |
| 2009/0051524 | A1 * | 2/2009 | Lim | A61B 5/00 340/501 |
| 2009/0089089 | A1 * | 4/2009 | Jang | G06F 19/3418 705/2 |
| 2010/0007502 | A1 * | 1/2010 | Noury | A61B 5/1113 340/573.1 |

FOREIGN PATENT DOCUMENTS

| | | | |
|---|---|---|---|
| KR | 1020070091969 | A | 9/2007 |
| KR | 1020090032339 | A | 4/2009 |
| KR | 1020100005494 | A | 1/2010 |

* cited by examiner

*Primary Examiner* — Phung Nguyen
(74) *Attorney, Agent, or Firm* — William Park & Associates Ltd.

(57) ABSTRACT

The present invention relates to an apparatus and a method for supporting a safe living. An embodiment of the present invention provides an apparatus for supporting a safe living that includes: an information receiving unit configured to receive information on a sensor, information on a device and information on a user; a pattern information generating unit configured to generate condition pattern information by use of sensing value information measured by the sensor and operation state information of the device; a condition assessing unit configured to assess a current condition by comparing the condition pattern information with the sensing value information and the operation state information; a profile unit configured to search for a control service of the device corresponding to the current condition; and a condition handling unit configured to perform a proper control the device corresponding to the current condition based on the control service.

11 Claims, 4 Drawing Sheets

FIG. 3

| Activity | Context | Devices | Location | Frequency | | | | Sensor Event |
|---|---|---|---|---|---|---|---|---|
| Waking Up | Alarm Sound | Clock | Bedroom | Number of Alarm Sounds | 1 | Little Tired | | |
| | Refrigerator Open | Refrigerator | Kitchen | | 5 | Very Tired | | |
| | Light On | Light | Bedroom, Kitchen, Bathroom | | | | default | |
| | Refrigerator Open | Refrigerator | Kitchen | Number of Door Opening and Closing | | | option | Sequence Important |
| | Water On | Water sensor | Kitchen,Bathroom | start time, duration | | First Open Time and Location Important | | |
| | Rice Cooker On | Rice Cooker | Kitchen | | | | | |
| | Gas Range(Gas Valve Open) | Gas Range | Kitchen | | | | | |
| | TV On | TV | Living Room | | | | default/option | |
| | gate open | door gate | Entrance | Number of Door Opening and Closing | | | default/option | Sequence Important |
| Dining | Refrigerator Open | Refrigerator | Kitchen | Number of Door Opening and Closing | | | | |
| | Rice Cooker On | Rice Cooker | Kitchen | | | | | |
| | Gas Range(Gas Valve Open) | Gas Range | Kitchen | | | | default | |
| | TV On | TV | Living Room | | | | default/option | |
| | Light On | Light | Kitchen | | Determine based on Current Time | | option | |
| | Microwave On | Microwave | Kitchen | | | | option | Sequence Important |
| | Kimchee Refrigerator Open | Kimchee Refrigerator | Kitchen | | | | option | Sequence Important |
| Normal Day | TV On | TV | Living Room | | | | default/option | |
| | Radio On | Radio On | Bedroom | | | | default/option | |
| | Light On | Light | Living Room | | Determine based on Current Time | | default/option | |
| | Computer On | Computer, Mouse, Keyboard | Bedroom or Living Room | | | | default/option | |
| | Refrigerator Open | Refrigerator | Kitchen | Number of Door Opening and Closing | | | default | |
| | Telephone Bell | Telephone | Living Room | Number of Rings | | | default | |
| | Washing Machine On | Washing Machine | Laundry Room | | | | default/option | Sequence Important |
| | Window Open | Window | Balcony, Bedroom | | | | default/option | Sequence Important |
| | Air Conditioner/Heater On | Air Conditioner /Heater | Living Room or Bedroom | | Determine based on Measured Room Temperature | | default/option | |
| | Vacuum Cleaner On | Vacuum Cleaner | home | | | | default/option | |
| | gate open | door gate | Entrance | Number of Door Opening and Closing | | | default/option | Sequence Important |
| | Gas Range(Gas Valve Open) | Gas Range | Kitchen | | Operate after Meal | | option | |
| | Water On | Water sensor | Kitchen,Bathroom | start time, duration | | First Open Time and Location Important | | |
| Sleeping | Light Off | Light | Bedroom | | | | default/option | |
| | TV Off | TV | Living Room | | | | default/option | |
| | gate close | door | Entrance | | | | default/option | Sequence Important |
| | Window close | Window | Balcony, Bedroom | | Seasonal Factor Required for Determination | | default/option | Sequence Important |

APPARATUS AND METHOD FOR SUPPORTING SAFE LIVING

CROSS-REFERENCE TO RELATED APPLICATIONS

This application claims the benefit of Korean Patent Application No. 10-2014-0029084, filed with the Korean Intellectual Property Office on Mar. 12, 2014, the disclosure of which is incorporated herein by reference in its entirety.

BACKGROUND

1. Technical Field

The present invention relates to an apparatus and a method for supporting a safe living.

2. Background Art

With the recent advancement of smart terminal technologies and the advent of home appliances having network functionalities, there have been incessant efforts for controlling various in-home devices or monitoring in-home states while there is no one home.

Moreover, as the information and communication technology is developed further, many devices are increasingly evolved to require integration with the information and communication technology when designing an internal architecture of a building.

In other words, living space, which used to be perceived as a simple space for resting, is being transformed to a high-tech space in which state-of-the-art technologies are integrated.

About the increasing trend for nuclear family and the change in demand for addressing insecure external experience in a personal space, futurist Faith Popcorn discussed about the cocooning trend of digging into a safe, cozy environment, such as family, for self-protection in her best-selling *The Popcorn Report* in 1991.

This new change of trend appears to inevitably expand in-house smart devices and sensor devices.

Accordingly, more meticulous and detailed extensions are required for services generally used for detecting unsafe situations in home, for example, fire-prevention using a smoke detector, shutting down a gas valve using a home automation device, turning a light on and off, etc.

Meanwhile, many video-based services used for prevention of trespassing, robbery, etc. are accompanied with high installation prices and problems in using the material for post-incident processing and in infringement of personal information.

While today's users have various demands for systems that can support the residents for safe living by use of smart terminals, smart devices and information from home-installed sensors, there have not been any specific systems designed to address these demands.

SUMMARY

An aspect of the present invention provides an apparatus and a method for supporting a safe living that can improve safety and living efficiency of the socially disadvantaged and those who need constant attention, by use of home-installed sensor devices and information obtained from smart terminals and smart devices used by a resident.

Another aspect of the present invention provides an apparatus and a method for supporting a safe living that can keep the resident from being conscious of the generation of status information of the resident, thereby minimizing any resistance against the devices or forced interruption of the devices.

Another aspect of the present invention provides an apparatus and a method for supporting a safe living that can solve social problems with the occurrence of dangerous situations with which it is impossible to deal due to the increase of single-person households caused by the increasing trend for nuclear family and the rapidly aging society.

Yet another aspect of the present invention provides an apparatus and a method for supporting a safe living that can provide a service space for satisfying the demands for communication with family and outside people from home due to the increased trend of cocooning.

Still another aspect of the present invention provides an apparatus and a method for supporting a safe living that can enable an automatic control and a remote notification of a home-environment recognition-based smart device while a guardian for a patient suffering with, for example, senile dementia, who is incapable of living alone or needs constant assistance, is temporarily absent.

An embodiment of the present invention provides an apparatus for supporting a safe living that includes: an information receiving unit configured to receive information on a sensor, information on a device and information on a user; a pattern information generating unit configured to generate condition pattern information by use of sensing value information measured by the sensor and operation state information of the device; a condition assessing unit configured to assess a current condition by comparing the condition pattern information with the sensing value information and the operation state information; a profile unit configured to search for a control service of the device corresponding to the current condition; and a condition handling unit configured to perform a proper control the device corresponding to the current condition based on the control service.

In one embodiment, the information receiving unit can include: a sensor information receiving unit configured to receive information on the sensor including at least one selected from the group consisting of a location, a type, a measurable value and a measuring frequency of the sensor; a device information receiving unit configured to receive information on the device including at least one selected from the group consisting of location information, attribute information and function and state information of the device; and a user information receiving unit configured to receive information on the user including at least one selected from the group consisting of space state information, attribute information and rule information of the user.

In another embodiment, the pattern information generating unit can include: a sensing pattern information generating unit configured to generate sensing pattern information using information on sensing start time, sensing finish time, sensing value, sensor threshold and sensing frequency received from the sensor; a device pattern information generating unit configured to generate device pattern information using state information, operation time, maximum operation time and periodicity information received from the device; and a user pattern information generating unit configured to generate user living pattern information using the sensing pattern information and the device pattern information.

In another embodiment, the user pattern information generating unit can be configured to receive the user living pattern information directly from the user.

In another embodiment, the profile unit can be configured to receive the control service directly from the user or obtain the control service through a web search.

In another embodiment, the apparatus for supporting a safe living can further include a transmitting unit configured to transmit information on the current condition to a safety service provider through a communication network.

Another aspect of the present invention provides a method for supporting a safe living that includes: receiving information on a sensor, information on a device and information on a user; generating condition pattern information using sensing value information measured by the sensor and operation state information of the device; assessing a current condition by comparing the condition pattern information with the sensing value information and the operation state information; searching for a control service of the device corresponding to the current condition; and performing a proper control of the device corresponding to the current condition based on the control service.

In one embodiment, the method can further include transmitting information on the current condition to a safety service provider through a communication network.

In another embodiment, the method can further include updating information on the control of the device corresponding to the current condition and user reaction information for the control of the device.

In another embodiment, the assessing of the current condition can be performed by assessing a condition individually according to a seriousness of the current condition.

In another embodiment, the method can further include performing a proper control of the device according to the seriousness of the current condition.

The apparatus and method for supporting a safe living in accordance with an embodiment of the present invention can help, for example, a dementia patient, who needs a constant supervision, to avoid a dangerous situation when the dementia patient has a momentary change of movement or loses a normal living pattern.

The apparatus and method for supporting a safe living in accordance with an embodiment of the present invention can allow moving lines and movement changes of the user based on location information and generated information of the sensors and devices.

The apparatus and method for supporting a safe living in accordance with an embodiment of the present invention can allow for prediction of possible situations in each space by separating device information and sensor information according to the residing space and allow for addressing the situations according to the device used by the user by using device attribute information.

The apparatus and method for supporting a safe living in accordance with an embodiment of the present invention can allow for immediate attention through remote control by a third person in a virtual space or device control by the condition handling unit, if a patient requiring attention is exposed to a dangerous situation.

The apparatus and method for supporting a safe living in accordance with an embodiment of the present invention can induce a change of situation through a device alarm and a user guidance service using environment information and manage the situation according to a reaction resulted from observation of a change in user motion, if an anomaly has occurred in the motion compared with an average reaction motion in a living pattern after the user's reaction to a specific device (e.g., a keyboard or mouse clicking reaction when using a computer) and a device location for a specific motion are assessed.

The apparatus and method for supporting a safe living in accordance with an embodiment of the present invention can allow the user's motion pattern and moving lines to be assessed using sensor information installed in the device and device attribute information for each living space and allow for immediate device control according to the seriousness of the assessed situation and for assessment of a dangerous situation by analyzing a trend of the user's motion change after a non-danger device operation, in order to reduce overhead costs due to periodical sensor information.

BRIEF DESCRIPTION OF THE DRAWINGS

FIG. 3 shows an example of On/Off operations of a device that can be used in the apparatus for supporting a safe living in accordance with an embodiment of the present invention.

DETAILED DESCRIPTION

Figure 1:
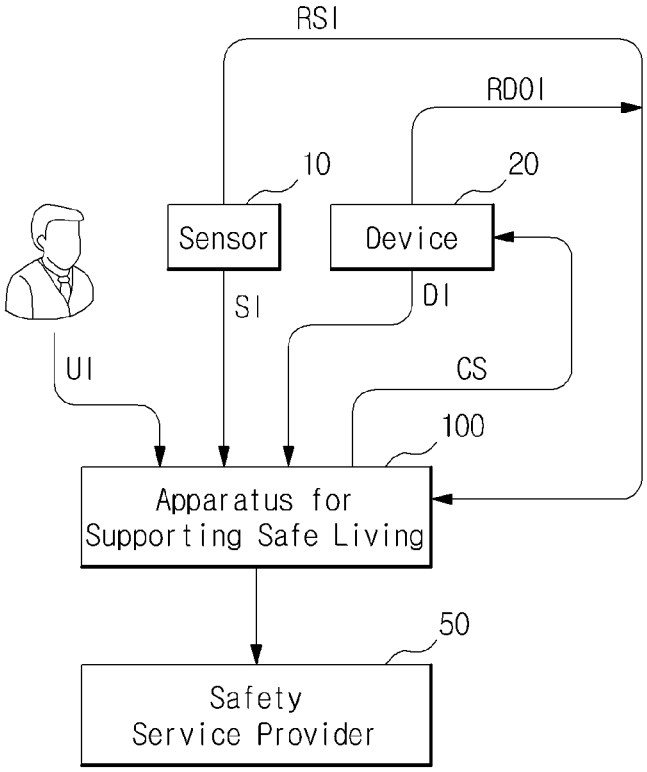
FIG. 1 is a conceptual diagram showing a flow of how an apparatus for supporting a safe living in accordance with an embodiment of the present invention operates.

Any structural or functional description specified for embodiments in accordance with the concept of the present invention disclosed in the present specification is simply provided for description of the embodiments in accordance with the concept of the present invention, and it shall be appreciated that the embodiments in accordance with the concept of the present invention may be embodied in various forms and may not be limited to the embodiments described herein.

Since there can be a variety of permutations and embodiments of the present invention, certain embodiments will be illustrated and described with reference to the accompanying drawings. This, however, is by no means to restrict the present invention to certain embodiments, and shall be construed as including all permutations, equivalents and substitutes covered by the ideas and scope of the present invention.

Terms such as "first" and "second" can be used in describing various elements, but the above elements shall not be restricted to the above terms. The above terms are used only to distinguish one element from the other. For instance, the first element can be named the second element, and vice versa, without departing the scope of claims of the present invention. The term "and/or" shall include the combination of a plurality of listed items or any of the plurality of listed items.

When one element is described as being "connected" or "accessed" to another element, it shall be construed as being connected or accessed to the other element directly but also as possibly having another element in between. On the other hand, if one element is described as being "directly connected" or "directly accessed" to another element, it shall be construed that there is no other element in between. Other expressions describing relations between the elements, for example, "between" and "directly between" or "adjacent" and "directly adjacent," shall be interpreted in the same fashion.

The terms used in the description are intended to describe certain embodiments only, and shall by no means restrict the present invention. Unless clearly used otherwise, expressions in a singular form include a meaning of a plural form. In the present description, an expression such as "comprising" or "including" is intended to designate a characteristic, a number, a step, an operation, an element, a part or combinations thereof, and shall not be construed to preclude any presence or possibility of one or more other characteristics, numbers, steps, operations, elements, parts or combinations thereof.

Unless otherwise defined, all terms, including technical terms and scientific terms, used herein have the same meaning as how they are generally understood by those of ordinary skill in the art to which the invention pertains. Any term that is defined in a general dictionary shall be construed to have the same meaning in the context of the relevant art, and, unless otherwise defined explicitly, shall not be interpreted to have an idealistic or excessively formalistic meaning.

Hereinafter, some embodiments will be described in detail with reference to the accompanying drawings. Identical or corresponding elements will be given the same reference numerals, regardless of the figure number, and any redundant description of the identical or corresponding elements will not be repeated. Throughout the description of the present invention, when describing a certain relevant conventional technology is determined to evade the point of the present invention, the pertinent detailed description will be omitted.

FIG. 1 is a conceptual diagram showing a flow of how an apparatus for supporting a safe living in accordance with an embodiment of the present invention operates.

Referring to FIG. 1, an apparatus 100 for supporting a safe life can receive sensor information SI from a sensor 10. Here, the sensor information SI can include information on sensor ID, sensor type, sensing frequency and sensor location.

The apparatus 100 for supporting a safe living can receive device information DI from a device 20. Here, the device information DI can include information on device ID, device type and device location.

The apparatus 100 for supporting a safe living can receive user information UI from a user. Here, the user information UI can include information on space, attributes and rules of the user.

The user can input the user information UI directly into the apparatus 100 for supporting a safe living. The user can input information on, for example, the space in which the user resides, the device that the user is using, and the arrangement of the device, into the apparatus 100 for supporting a safe living.

For example, the user can input the layout of the user's living space, including a master bedroom, a living room and a kitchen. Moreover, the user can input information on a bed, a lamp, an electric blanket, a refrigerator, a washing machine, etc., which are used by the user. Furthermore, the user can input information on a resident, including an age, a basic living cycle, etc.

The apparatus 100 for supporting a safe living can generate condition pattern information by use of realtime sensing information RSI, which is received from the sensor 10, and realtime device operating information RDOI, which is received from the device 20.

The apparatus 100 for supporting a safe living can assess a current condition by comparing the pattern information with the information, i.e., RSI and RDOI, received in real time from the sensor 10 and the device 20.

Here, the current condition can include various conditions that can occur to the user, for example, a dangerous situation, including a situation requiring an operation of the device 20 or a situation requiring to provide a help to the user.

The apparatus 100 for supporting a safe living can search for a control service of the device 20 corresponding to the current condition and perform a control of the device 20 corresponding to the current condition based on the searched control service. The apparatus 100 for supporting a safe living can transmit a control signal CS for controlling the device 20 to the device 20.

The apparatus 100 for supporting a safe living can transmit the information on the current condition, the information on the control of the device 20, and the information on the current state of the user to a safety service provider 50. Here, the safety service provider 50 can be an institution or organization that can provide a help to the user and can include a service provider that can provide a care service to the user.

Moreover, the apparatus 100 for supporting a safe living can transmit the information on the current condition to, for example, the guardian of the user. The guardian of the user can receive the information on the current condition of the user and information on how the user is being cared and can undertake an additional measure.

Through this, an embodiment of the present invention allows potential conditions to be predicted using the device information DI and the sensor information SI based on the resident's space. Moreover, by using the attribute information of the device 20, the conditions can be addressed according to the device 20 used by the user, and in case the user is exposed to a dangerous situation, the situation can be immediately addressed through a remote control of a third party in a virtual space or through a control of the apparatus 100 for supporting a safe living.

Figure 2:
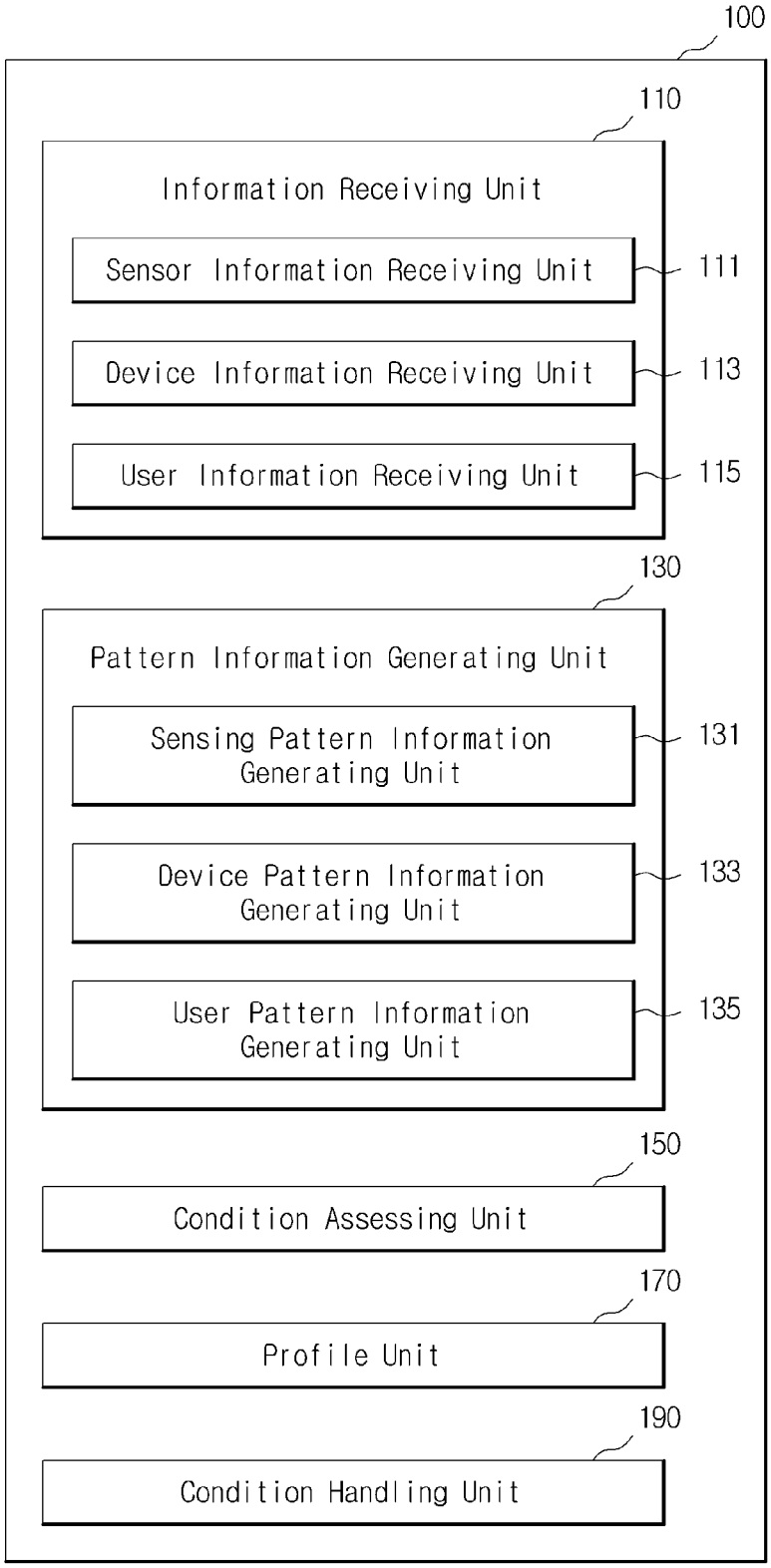
FIG. 2 shows an internal configuration of the apparatus for supporting a safe living in accordance with an embodiment of the present invention.

FIG. 2 shows an internal configuration of the apparatus 100 for supporting a safe living in accordance with an embodiment of the present invention.

Referring to FIG. 2, the apparatus 100 for supporting a safe living in accordance with an embodiment of the present invention can include an information receiving unit 110, a pattern information generating unit 130, a condition assessing unit 150, a profile unit 170 and a condition handling unit 190.

The information receiving unit 110 can receive information on the sensor 10, information on the device 20 and information on the user.

The information on the sensor 10 can include a sensor ID, a sensor location, a sensor type, a measurable value of the sensor and a measuring frequency of the sensor.

If the sensor 10 supports the plug-and-play functionality, the apparatus 100 for supporting a safe living can obtain the information on the sensor 10 from the sensor, and if the sensor does not support the plug-and-play functionality, the user can directly input the information on the sensor 10.

The information on the device 20 can include device location information, device attribute information, device function information and device state information.

The apparatus 100 for supporting a safe living can obtain the information on the device 20 from the device 20, or, if necessary, the user can directly input the information on the device 20.

For instance, the user can input information on a door installed in the space in which the user resides. The information on the door can include location information, attribute information, function information and state information of the door.

In another example, the user can input information on a washing machine used by the user. The information on the washing machine can include location information, attribute information, function information and state information of the washing machine.

Furthermore, the user can input information on a sensor 10 installed in the washing machine.

The information on the sensor installed in the washing machine can include information on a contact sensor that can determine whether the user is using the washing machine.

The information on the sensor installed in the washing machine can include information on a pressure sensor and a gravity sensor installed around the washing machine in order to determine whether the washing machine is being used.

Here, the pressure sensor and the gravity sensor can determine whether the user is positioned in front of the washing machine and determine whether the user is using the washing machine by checking the information on the contact sensor.

Accordingly, it becomes possible to assess the user and the user's moving lines by use of the device location information and values from the pressure sensor and the gravity sensor, without using video information.

The pattern information generating unit 130 can generate pattern information using the information received from the sensor 10 and the device 20.

The pattern information generating unit 130 can include a sensing pattern information generating unit 131, a device pattern information generating unit 133 and a user pattern information generating unit 135.

The sensing pattern information generating unit 131 can generate sensing pattern information using information on sensing start time, sensing finish time, sensing value, sensor threshold and sensing frequency.

The device pattern generating unit 133 can generate device pattern information using device state information, device operation time, maximum device operation time and device periodicity information received from the device 20.

For example, it is possible to sense an operation pattern of the user by measuring clicking speeds of a mouse and a keyboard of the user who is using a computer for documentation, web surfing, playing a game, etc.

The user pattern information generating unit 135 can generate user living pattern information using the sensing pattern information and the device pattern information.

Moreover, the user pattern information generating unit 135 can generate the user living pattern information by learning the sensing pattern information and the device pattern information.

For example, the pattern information generating unit 130 can generate information on the user's moving lines using sensing value information measured by the sensor and device location information.

Moreover, the user pattern information generating unit 135 can have the user living pattern information inputted thereto from the user. For example, in case the user's living pattern occurs mostly in a space where TV is, the user can directly input the user living pattern information that can occur around the TV.

The condition assessing unit 150 can cases the current condition by comparing real-time information received from the sensor 10 and the device 20 with the pattern information generated by the pattern information generating unit 130.

Here, the current condition can include dangerous situations detected by simple sensor operations, for example, fire detected by a heat sensor or a smoke detector, gas leak detected by a gas sensor, trespassing detected a door sensor, etc.

Moreover, the condition assessing unit 150 can assess conditions such as dishwashing after dining, moving the laundry to a clothes horse, and going in and out based on opening and closing the door. Furthermore, the condition assessing unit 150 can assess the current condition that is irrelevant to an operation sequence of the device 20, and can assess the current condition by grouping the devices installed in the space, mapping the device with the sensing information and applying a weighted value to a particular device.

For example, the devices 20 installed in the kitchen can include a gas range, a kitchen sink, an electric cooker, a microwave oven, a refrigerator, a rice bin, a dining table, chairs, etc., and used for the sensor 10 attached to the devices 20 can be a door on/off sensing contact sensor, a weight sensor for checking the movement of the user and the operation time.

The condition assessing unit 150 can define the devices 20 into groups and use the pattern information received from the pattern information generating unit 130 to assess whether the user has entered the kitchen to prepare for a meal or for some other reason.

If the condition assessing unit 150 assesses that the user is preparing a meal, the condition assessing unit 150 can check for activation and operation time of each device 20 to determine whether an abnormal situation has occurred, and can send the determined situation to the condition handling unit 190.

The profile unit 170 can search for a control service of the device 20 corresponding to the current condition. The profile unit 170 can receive and store control services directly from the user, and can search for the control service of the device 20 from the stored control services. Moreover, the profile unit 170 can obtain the control service through searching the Internet.

A control service provider can provide a control service related to the sensor 10 and the device 20 to the user directly or through a web service.

In case the control service provider develops a new service for controlling the sensor 10 and the device 20, the newly developed control service can be uploaded on a homepage of the control service provider or updated through a communication network.

The condition handling unit 190 can perform a proper control of the device 20 for the current condition based on the control service. The condition handling unit 190 can notify the device control and dangerous situation.

[Table 1] below shows the steps being processed by the condition handling unit 190 for the current condition in accordance with an embodiment of the present invention.

TABLE 1

| Device 20/ Sensor 10 | Pattern Information Generating Unit 130 | Condition Assessing Unit 150 | Condition Handling Unit 190 |
|---|---|---|---|
| Washing Machine | Duration of running the washing machine: 30 minutes (1st day), 35 minutes (2nd day), 40 minutes (3rd day); Duration of stay with the washing machine for operation (by use of weight sensor): 10 minutes (1st day), 8 minutes (2nd day), 13 minutes (3rd day); | Compare pattern information (daily average use of 35 minutes) with real-time input information (use of 0 minute, duration of stay 15 minutes); Consider weather information (sunny); Profile search: User has forgotten or is unable to move. | Request to provide the care service to the user; Request a laundry service provider for a service; Send a message to a nearby family member; Request a security guard service for assistance; Send a message to a remote guardian; |

TABLE 1-continued

| Device 20/ Sensor 10 | Pattern Information Generating Unit 130 | Condition Assessing Unit 150 | Condition Handling Unit 190 |
|---|---|---|---|
| | Pattern information: Daily average use of 35 minutes | | Contact a family doctor for health status checkup; |
| Washing Machine Door Sensor | Time of opening the door sensor of washing machine: 08:00 ($1^{st}$ day), 08:30 ($2^{nd}$ day), 09:00 ($3^{rd}$ day); Pattern Information: Washing machine operated around 08:30 each day for about 10 minutes average | Compare pattern information (washing machine operated around 08:30 each day) with real-time input information (no opening time of washing machine door); Consider weather information (sunny); Profile search: User is unable to move; if, based on the user profile, the user has mild dementia, the user has forgotten to do the laundry, but if the user has no dementia, the user is unable to move. | Request for pattern information update |

Referring to [Table 1], the pattern information generating unit 130 can generate information on the duration of running the washing machine. It can be seen that the washing machine was operated for 40 minutes on the first day, 35 minutes on the second day, and 40 minutes on the third day. The pattern information generating unit 130 can obtain the pattern information that the daily average use duration of the washing machine is 35 minutes.

In the same fashion, the pattern information generating unit 130 can use the information on the time of opening the door sensor of the washing machine to obtain the pattern information that the user runs the washing machine around 08:30 each day.

The condition assessing unit 150 can have information on the duration of running the washing machine and the time of using the washing machine inputted thereto and compare this information with the pattern information. If the duration of running the washing machine is dramatically reduced to zero (0), weather information can be considered, and a search can be performed through the profile unit 170 for the currently occurred situation.

If no running time of the washing machine is detected despite the sunny weather, the condition assessing unit 150 can assess that the use is unable to move. If the situation, in which the user is unable to move, has occurred, the condition handling unit 190 can provide a measure for solving the current condition by requesting a care service to be provided to the user or requesting a laundry service provider for a service and sending a message to nearby family member.

FIG. 3 shows an example of On/Off operations of a device that can be used in the apparatus for supporting a safe living in accordance with an embodiment of the present invention. Through this, possible scenarios of inputting information of the devices 20 and the sensors 10 are based on the living pattern of the user.

Figure 4:
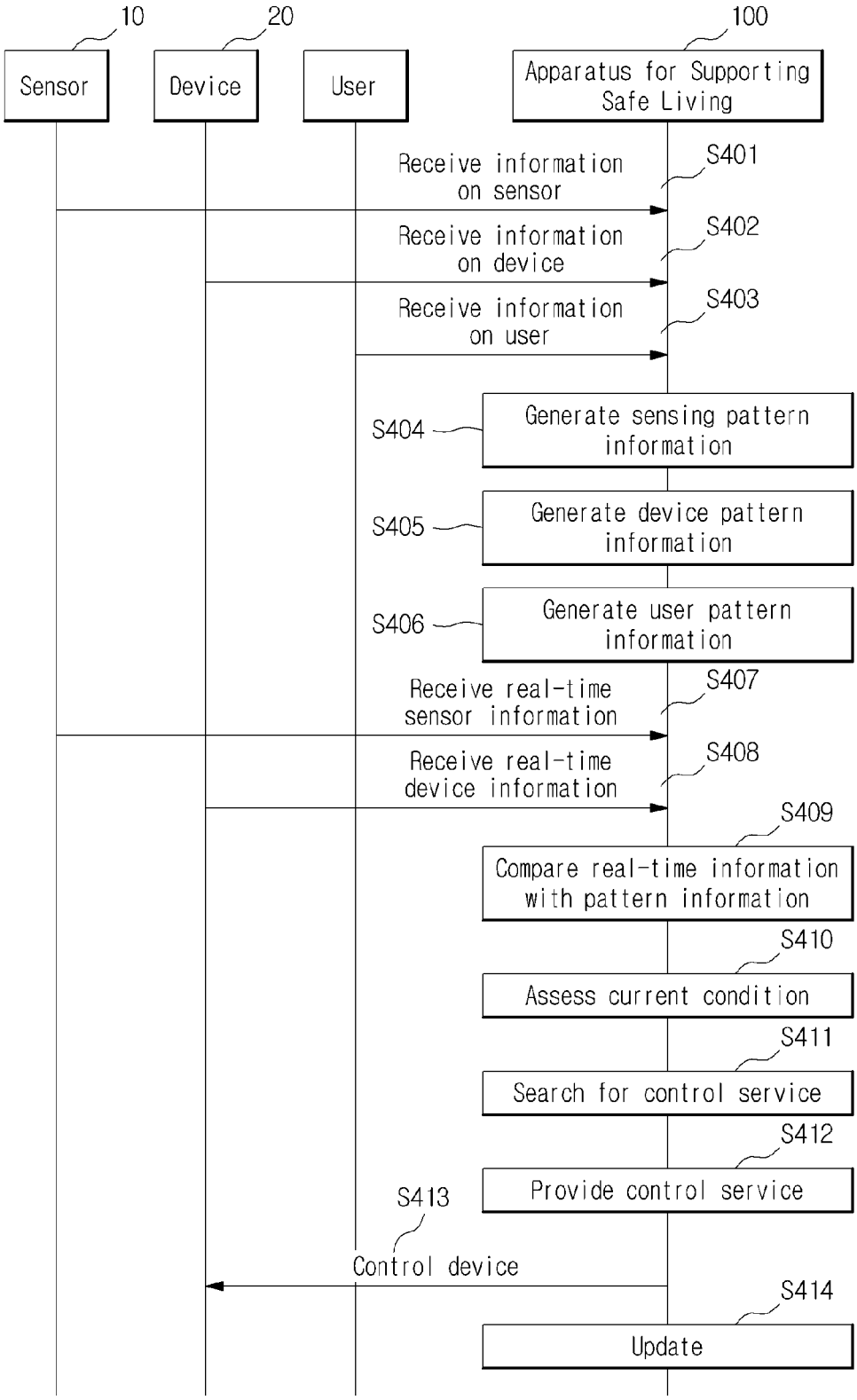
FIG. 4 is a flow diagram showing a method for supporting a safe living in accordance with an embodiment of the present invention.

FIG. 4 is a flow diagram showing a method for supporting a safe living in accordance with an embodiment of the present invention.

Referring to FIG. 4, in step S401, the apparatus 100 for supporting a safe living can receive sensor information from the sensor 10.

In step S402, the apparatus 100 for supporting a safe living can receive device information from the device 20.

In step S403, the apparatus 100 for supporting a safe living can receive user information from the user.

In steps S404 and S405, the apparatus 100 for supporting a safe living can generate pattern information by receiving a sensing value from the sensor 10 and device operation state information from the device 20.

The pattern information generated in steps S404 and S405 can provide a basis for determining whether the user is going through a normal routine.

For example, using the sensing value received from the sensor 10, sensing pattern information can be generated and compared with a sensing value received in real time, and if a sensing value exceeding a predetermined range is detected, the apparatus 100 for supporting a safe living can determine that an abnormal situation has occurred to the user.

In step S406, the apparatus 100 for supporting a safe living can generate user pattern information using the pattern information generated in steps S404 and S405.

In another embodiment, the user can input the user pattern information directly.

In step S407, the apparatus 100 for supporting a safe living can receive real-time sensor information from the sensor 10.

In step S408, the apparatus 100 for supporting a safe living can receive real-time device information from the device 20.

In step S409, the apparatus 100 for supporting a safe living can compare the pattern information against the received real-time information.

In step S410, a current condition can be assessed through the information compared in step S409. Here, the current condition can include, for example, fire detected by a heat sensor or a smoke detector, gas leak detected by a gas sensor, trespassing detected a door sensor, etc.

In another embodiment, when the current condition is assessed, the current condition may be individually assessed according to the seriousness of the current condition.

For example, for the condition of fire, the device 20 can be controlled differently according to the severity of fire.

Furthermore, the apparatus 100 for supporting a safe living can transmit information on the current condition to a guardian or to a server of an institution or organization that can provide a protection service, through a communication network.

In step S411, the apparatus 100 for supporting a safe living can search for a control service of the device 20 corresponding to the current condition.

For example, the control service corresponding to the current condition can be inputted by the user, or the apparatus 100 for supporting a safe living can search the Internet for control services that have been pre-stored and obtain an appropriate service.

In step S412, the apparatus 100 for supporting a safe living can provide the control service of the device 20 corresponding to the current condition that is searched in step S411.

In step S413, the apparatus 100 for supporting a safe living can control the device 20.

In step S414, the apparatus 100 for supporting a safe living can update changed information. The pattern information may be changed during the update.

If, for example, when the real-time device information is received (S408), the apparatus 100 for supporting a safe living assesses that a hair dryer has been operated in excess of a predetermined maximum operation duration and thus assesses that the device is overheated (S410) and then turns the device off (S412), but new real-time device information indicates that the same device is turned on again by the user, the apparatus 100 for supporting a safe living is notified that the pattern information is changed. Accordingly, the apparatus 100 for supporting a safe living checks a threshold repetition number for update of the pattern information and then finally performs the update (S414).

The steps of the methods or algorithms described in conjunction with the embodiments described herein can be implemented by hardware, a software module executed by a processor, or a combination thereof. The software module may be stored in a RAM memory, a flash memory, a ROM memory, an EPROM memory, an EEPROM memory, a register, a hard disk, a detachable disk, a CD-ROM, or any storage medium well known to those who are skilled in the art. The storage medium may be connected with the processor, and thus the processor can allow information to be read from the storage medium and written in the storage medium. Alternatively, the storage medium can be integrated with the processor. The processor and the storage medium may reside in ASIC, which may be located within a user terminal Alternatively, the processor and the storage medium may reside in the user terminal as additional components.

The above-mentioned processors may be implemented in one or more general-purpose or special purpose computers or software code modules executed by the processors, and be fully automated through the software code modules. The code modules may be stored in any type of computer readable media or other computer storage devices or a set of storage devices. Some or all of the methods may be implemented in specialized computer hardware.

The above-mentioned methods and tasks may be executed and fully automated by a computer system. The computer system may communicate through a network to conduct the above-mentioned functions and include multiple individual computers which are interoperating and computing devices such as physical servers, workstations, storage arrays and the like. Each computing device generally includes program instructions stored in a memory or a non-transitory computer-readable storage medium or processors executing modules (or multi-processors or circuit or set of circuits such as modules). Some or all of the above-mentioned various functions may be implemented with application-specific circuits such as ASICs or FPGAs of a computer system, but the above-mentioned various functions may be implemented with such program instructions. When the computer system includes several computing devices, the devices may be positioned at the same place, although it is not necessary. The above-mentioned methods and the results of the tasks may be stored permanently in different states by translating physical storage devices such as solid state memory chips and/or magnetic disks.

While the present invention has been described with reference to certain embodiments, it shall be appreciated that various permutations and modifications may be made by those skilled in the art without departing from the technical ideas and scope of the present invention, which shall be defined by the appended claims.

What is claimed is:

1. An apparatus for supporting a safe living, comprising:

an information receiving unit configured to receive information on a sensor, information on a device and information on a user;

a pattern information generating unit configured to generate condition pattern information by use of sensing value information measured by the sensor and operation state information of the device;

a condition assessing unit configured to assess a current condition by comparing the condition pattern information with the sensing value information and the operation state information;

a profile unit configured to search for a control service of the device corresponding to the current condition; and a condition handling unit configured to perform a proper control the device corresponding to the current condition based on the control service.

2. The apparatus of claim 1, wherein the information receiving unit comprises:

a sensor information receiving unit configured to receive information on the sensor including at least one selected from the group consisting of a location, a type, a measurable value and a measuring frequency of the sensor;

a device information receiving unit configured to receive information on the device including at least one selected from the group consisting of location information, attribute information and function and state information of the device; and a user information receiving unit configured to receive information on the user including at least one selected from the group consisting of space state information, attribute information and rule information of the user.

3. The apparatus of claim 1, wherein the pattern information generating unit comprises:

a sensing pattern information generating unit configured to generate sensing pattern information using information on sensing start time, sensing finish time, sensing value, sensor threshold and sensing frequency received from the sensor;

a device pattern information generating unit configured to generate device pattern information using state information, operation time, maximum operation time and periodicity information received from the device; and a user pattern information generating unit configured to generate user living pattern information using the sensing pattern information and the device pattern information.

4. The apparatus of claim 3, wherein the user pattern information generating unit is configured to receive the user living pattern information directly from the user.

5. The apparatus of claim 1, wherein the profile unit is configured to receive the control service directly from the user or obtain the control service through a web search.

6. The apparatus of claim 1, further comprising a transmitting unit configured to transmit information on the current condition to a safety service provider through a communication network.

7. A method for supporting a safe living, comprising:

receiving information on a sensor, information on a device and information on a user;

generating condition pattern information using sensing value information measured by the sensor and operation state information of the device;

assessing a current condition by comparing the condition pattern information with the sensing value information and the operation state information;

searching for a control service of the device corresponding to the current condition; and performing a proper control of the device corresponding to the current condition based on the control service.

8. The method of claim 7, further comprising transmitting information on the current condition to a safety service provider through a communication network.

9. The method of claim 7, further comprising updating information on the control of the device corresponding to the current condition and user reaction information for the control of the device.

10. The method of claim 7, wherein the assessing of the current condition is performed by assessing a condition individually according to a seriousness of the current condition.

11. The method of claim 10, further comprising performing a proper control of the device according to the seriousness of the current condition.

* * * * *